US008132563B2

(12) United States Patent
Gore

(10) Patent No.: US 8,132,563 B2
(45) Date of Patent: Mar. 13, 2012

(54) GAS SPRING ASSEMBLY FOR AN AIR GUN

(76) Inventor: Thomas Gore, South Lyon, MI (US)

( * ) Notice: Subject to any disclaimer, the term of this patent is extended or adjusted under 35 U.S.C. 154(b) by 451 days.

(21) Appl. No.: 12/509,005

(22) Filed: Jul. 24, 2009

(65) Prior Publication Data

US 2011/0017186 A1 Jan. 27, 2011

(51) Int. Cl.
*F41B 11/00* (2006.01)

(52) U.S. Cl. ..... 124/65

(58) Field of Classification Search ..... 124/64–68
See application file for complete search history.

(56) References Cited

U.S. PATENT DOCUMENTS 3,552,372 A * 1/1971 Wilkerson ..... 124/67
3,951,038 A * 4/1976 Van Langenhoven ..... 89/7
4,709,686 A 12/1987 Taylor et al.
4,771,758 A 9/1988 Taylor et al.
4,850,329 A 7/1989 Taylor et al.
5,193,517 A 3/1993 Taylor et al.
5,570,676 A 11/1996 Gore
6,901,689 B1 * 6/2005 Bergstrom ..... 42/1.06

* cited by examiner

*Primary Examiner* — Troy Chambers
(74) *Attorney, Agent, or Firm* — Quinn Law Group, PLLC

(57) ABSTRACT

An air gun including a trigger assembly, a gas spring assembly, and a latch assembly is disclosed. The trigger assembly is moveable between an uncocked position and a cocked position. The gas spring assembly includes a compression cylinder and a piston moveable between an uncompressed position and a compressed position. Movement of the piston from the uncompressed position into the compressed position couples the latch assembly to the trigger assembly and the piston of the gas spring assembly. The latch assembly includes a locking portion that mechanically interlocks with a recess disposed on an interior surface of the piston to couple the latch assembly and the piston together. Actuation of the trigger assembly de-couples the latch assembly from the trigger assembly, permitting longitudinal movement of the latch assembly, which de-couples the latch assembly from the piston of the gas spring assembly.

25 Claims, 7 Drawing Sheets

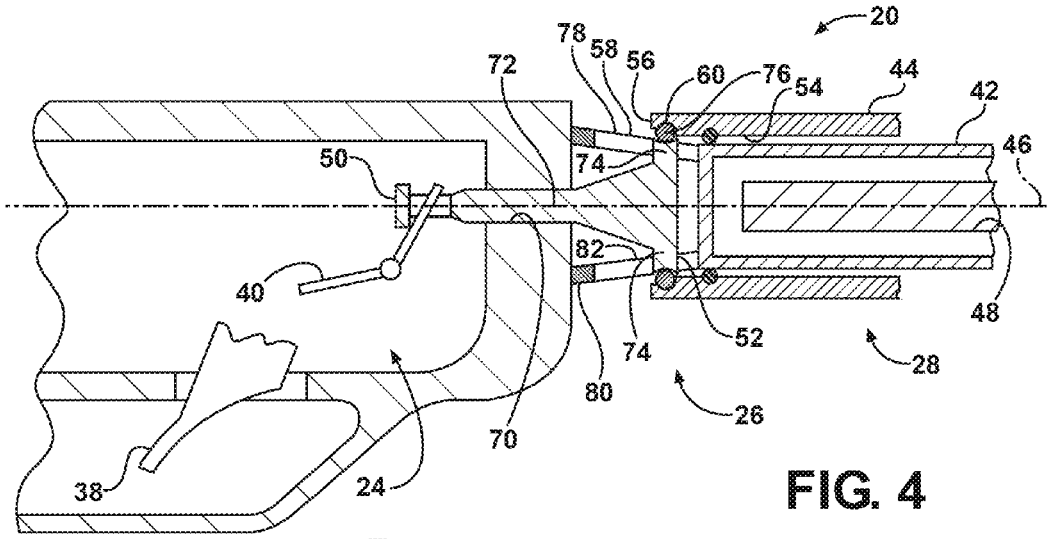
FIG. 4
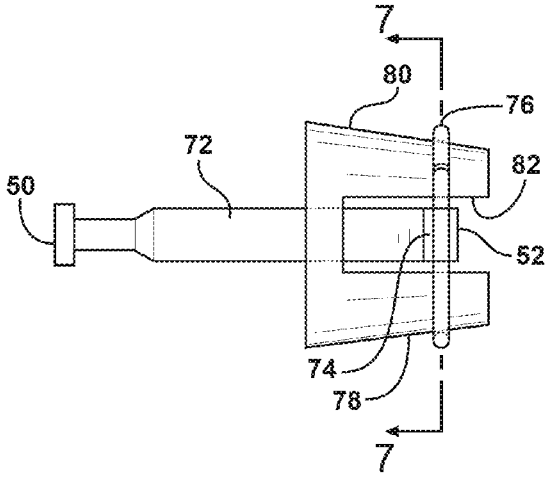
FIG. 5
FIG. 6
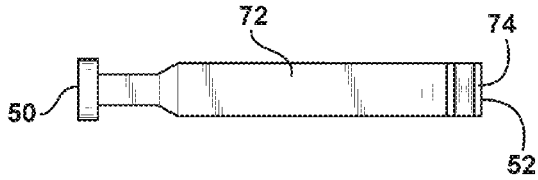
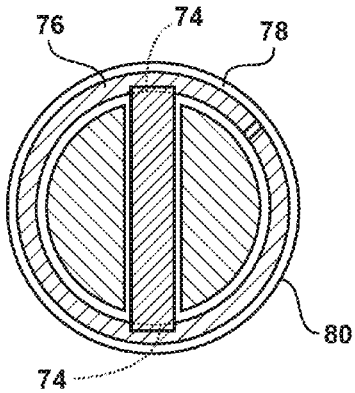
FIG. 7

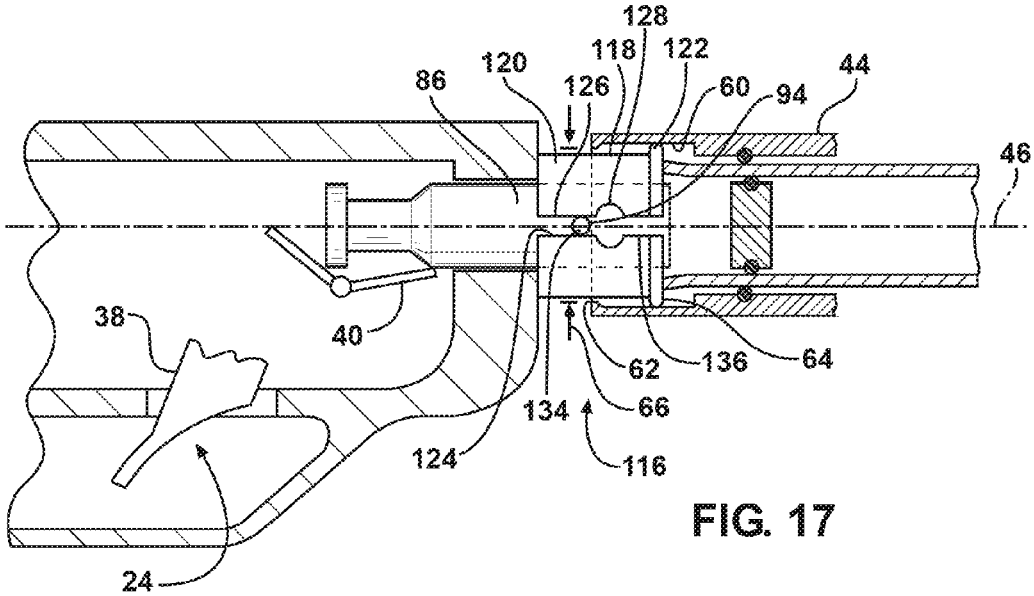
FIG. 17
FIG. 18
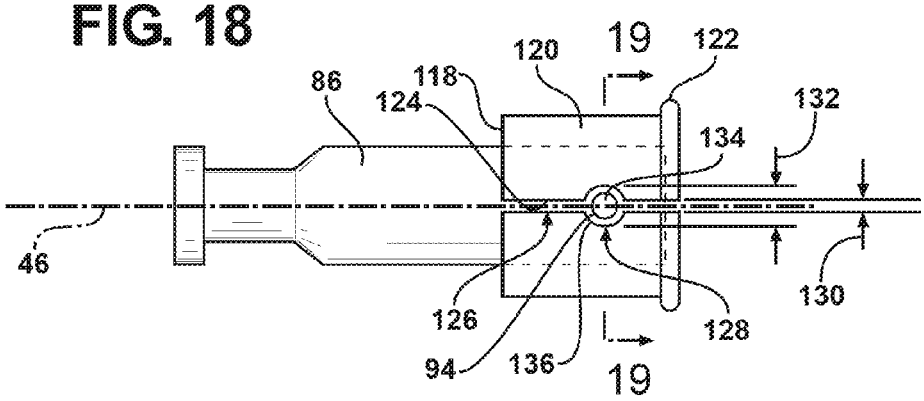
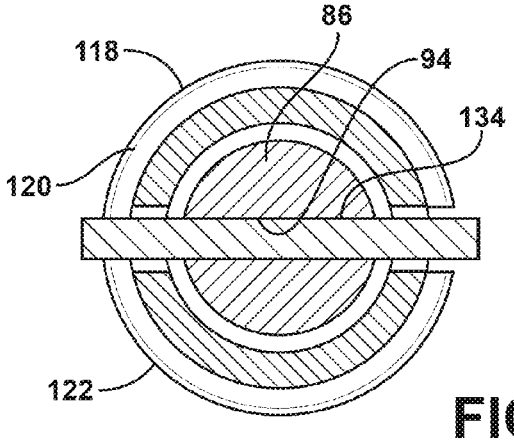
FIG. 19

GAS SPRING ASSEMBLY FOR AN AIR GUN

TECHNICAL FIELD

The present invention generally relates to air guns, and more specifically to a gas spring assembly for an air gun.

BACKGROUND OF THE INVENTION

An air gun is a rifle, pistol, etc., which utilizes a compressed gas to fire a projectile. Air guns may be powered by, for example, a coil spring loaded piston or an air-spring loaded piston.

Air guns powered by the coil spring loaded piston include a common trigger assembly, a coil spring assembly housed within a compression chamber of the rifle, and a barrel. The coil spring assembly includes a coil spring coupled to a piston. Cocking the gun moves the piston, which compresses the coil spring until a latch on the rear of the piston engages a sear on the trigger assembly. The coil spring assembly permits use of a center, i.e., an in-line latch, wherein the latch on the rear of the piston is generally in-line and concentric with a longitudinal axis of the piston. Actuating the trigger assembly releases the sear of the trigger assembly and allows the coil spring to decompress, pushing the piston forward, and thereby compressing the gas, i.e., air, in the compression chamber directly behind the projectile. Once the air pressure rises to a level sufficient to overcome any static friction and/or barrel restriction between the projectile and the barrel, the projectile moves forward within the barrel, propelled by an expanding column of gas.

The air-spring loaded piston includes a sealed compression cylinder disposed within the piston. The compression cylinder contains a gas, such as air or nitrogen. Cocking the gun moves the piston, which compresses the gas within the compression cylinder until the latch on the rear of the piston engages a sear on the trigger assembly. If the compression cylinder includes a single dynamic compression seal, i.e., if the compression cylinder includes only a single moving seal to contain the pressurized gas within the compression cylinder, then the trigger assembly must engage the piston at an outer surface thereof. In order to use the center, i.e., in-line latch generally associated with the coil spring loaded piston assembly described above, then a double dynamic seal compression cylinder may be utilized, i.e., the compression cylinder includes a center rod for engaging the center latch, and two moving seals to seal the compression cylinder against both the piston and the center rod.

SUMMARY OF THE INVENTION

An air gun is provided. The air gun includes a trigger assembly. The trigger assembly is moveable between a cocked position and an uncocked position. The air gun further includes a gas spring assembly. The gas spring assembly includes a compression cylinder and a piston. The piston is slideably disposed over and moveable along a longitudinal axis relative to the compression cylinder. The piston is moveable between a compressed position and an uncompressed position. The gas spring assembly is configured for compressing a gas within the compression cylinder in response to movement of the piston from the uncompressed position into the compressed position. Compressing the gas within the compression cylinder loads the gas spring assembly in preparation for firing a projectile when actuated by the trigger assembly. The air gun further includes a latch assembly. The latch assembly is moveable along the longitudinal axis relative to the trigger assembly and the gas spring assembly. The latch assembly includes a first end and a second end spaced from the first end along the longitudinal axis. The first end is releasably coupled to the trigger assembly when the trigger assembly is in the cocked position. The first end is de-coupled from the trigger assembly when the trigger assembly is in the uncocked position. The second end is releasably coupled to the piston of the gas spring assembly when the piston is in the compressed position. The second end is de-coupled from the piston of the gas spring assembly when the piston is in the uncompressed position.

A gas spring assembly for an air gun is also provided. The gas spring assembly includes a compression cylinder extending along a longitudinal axis, and a piston slideably disposed over and moveable along the longitudinal axis relative to the compression cylinder. The piston is moveable between a compressed position and an uncompressed position. The compression cylinder and the piston are configured for compressing a gas within the compression cylinder in response to movement of the piston from the uncompressed position into the compressed position. The gas spring assembly further includes a latch assembly. The latch assembly includes a barrel portion concentric with the longitudinal axis. The latch assembly is moveable along the longitudinal axis relative to the compression cylinder and the piston. The latch assembly includes a first end and a second end spaced from the first end along the longitudinal axis. The second end is releasably coupled to the piston when the piston is in the compressed position. The second end is de-coupled from the piston when the piston is in the uncompressed position. The latch assembly includes a locking portion disposed adjacent the second end of the latch assembly. The piston includes a receiving end defining an aperture and an interior surface defining a recess adjacent the receiving end. The receiving end is configured for receiving the locking portion therethrough. The recess configured for mechanically interlocking with the locking portion of the latch assembly when the piston is in the compressed position.

Accordingly, the latch assembly couples and/or interconnects the gas spring assembly and the trigger assembly, and permits the gas spring assembly to utilize a single dynamic seal gas spring along with an in-line or center latch system commonly utilized in existing air guns. The single dynamic gas spring in combination with the center latch is a more powerful and/or accurate combination than the double dynamic gas spring/center latch combination or the single dynamic gas spring/side latch combination utilized in the prior art gas spring powered air guns.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 4 is a schematic fragmentary cross sectional view of the air gun showing the trigger assembly in a cocked position, the first alternative embodiment of the gas spring assembly in a compressed position and the first alternative embodiment of the latch assembly coupled to the piston of the first alternative embodiment of the gas spring assembly.

FIG. 5 is a schematic top plan view of the first alternative embodiment of the latch assembly.

FIG. 6 is a schematic top plan view of a barrel portion of the first alternative embodiment of the latch assembly.

FIG. 7 is a schematic cross sectional view of the first alternative embodiment of the latch assembly taken along cut line 7-7 shown in FIG. 5.

FIG. 17 is a schematic cross sectional view of the air gun showing the trigger assembly in the cocked position, the first alternative embodiment of the gas spring assembly, and a fourth alternative embodiment of the latch assembly.

FIG. 18 is a schematic top plan view of the fourth alternative embodiment of the latch assembly shown in FIG. 17.

FIG. 19 is a schematic cross sectional view of the fourth alternative embodiment of the latch assembly shown in FIG. 17 and taken along cut line 19-19 shown in FIG. 18.

DESCRIPTION OF THE PREFERRED EMBODIMENTS

Figure 1:
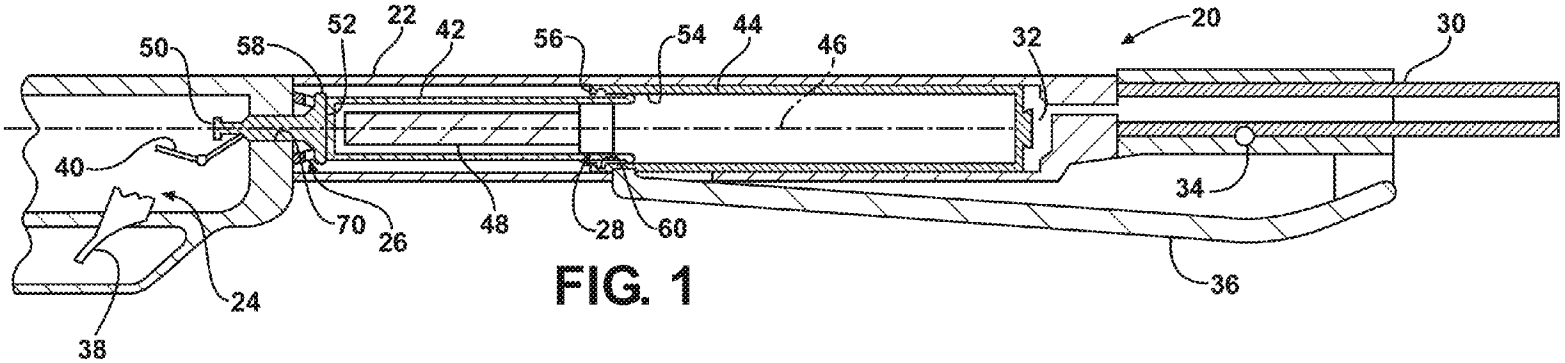
FIG. 1 is a schematic cross sectional view of an air gun.

Referring to the Figures, wherein like numerals indicate corresponding parts throughout the several views, an air gun is shown generally at 20. The air gun 20 includes a stock 22, a trigger assembly 24, a latch assembly 26, a gas spring assembly 28 and a barrel 30. The air gun 20 utilizes a burst of compressed air to fire a projectile. Throughout FIGS. 1-7, a first alternative embodiment of the latch assembly 26 is shown in FIGS. 1, 2 and 4-7, and a first alternative embodiment of the gas spring assembly 28 is shown in FIGS. 1-2 and 4.

Figure 2:
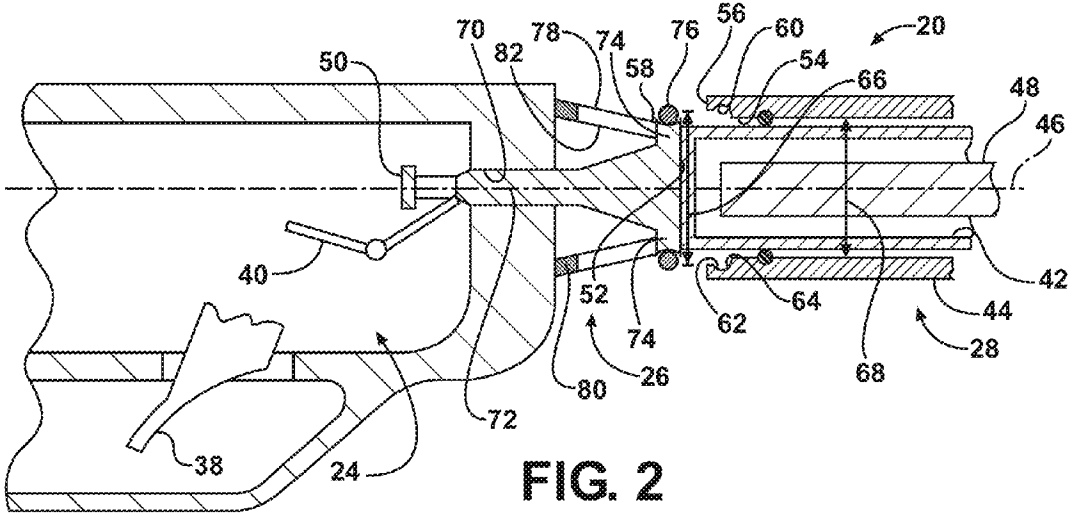
FIG. 2 is a schematic fragmentary cross sectional view of the air gun showing a trigger assembly in an uncocked position, a first embodiment of an gas spring assembly in an uncompressed position and a first alternative embodiment of a latch assembly.

Referring to FIG. 1, the stock 22 defines a pressure chamber 32, with the gas spring assembly 28 disposed within the pressure chamber 32. The pressure chamber 32 is in fluid communication with the barrel 30. The barrel 30 is pivotably attached to the stock 22, and is pivotable about a shaft 34 between a firing position and a cocking position as is well known. A lever 36 interconnects the barrel 30 and the gas spring assembly 28. Movement of the barrel 30 from the firing position into the cocking position moves the lever 36, which in turn moves the gas spring assembly 28 from an uncompressed position into a compressed position. Movement of the barrel 30 from the firing position into the cocking position also moves the trigger assembly 24 from an uncocked position into a cocked position. Once the barrel 30 is moved back into the firing position, the air gun 20 is ready to fire.

Actuation of the trigger assembly 24 releases the gas spring assembly 28, which allows the gas spring assembly 28 to decompress. Decompression of the gas spring assembly 28 compresses the air contained within the pressure chamber 32, which fires the projectile.

The stock 22 may include any suitable size and/or shape, and may be configured as a rifle or a pistol. The stock 22 may include and be manufactured from any suitable material, such as a wood material, a plastic material, a composite material, or some other material capable of supporting the components of the air gun 20 during use, while permitting easy manufacture of the stock 22.

The trigger assembly 24 is housed within and supported by the stock 22. As noted above, the trigger assembly 24 is moveable between the cocked position and the uncocked position. The cocked position is generally associated with a ready to fire position, and the uncocked position is generally associated with a post firing, i.e., not-ready to fire position. The trigger assembly 24 may include any trigger assembly 24 commonly known and utilized to fire a weapon. Typically, the trigger assembly 24 includes a trigger 38, which operates a sear 40 through a mechanical connection. However, it should be appreciated that the trigger assembly 24 may be configured in some other manner.

The gas spring assembly includes a compression cylinder 42 and a piston 44. The piston 44 is slideably disposed about and moveable along a longitudinal axis 46 relative to the compression cylinder 42. The longitudinal axis 46 is concentric with the piston 44. As noted above, the piston 44 is moveable between the compressed position and the uncompressed position. The gas spring assembly is configured for compressing a gas within the compression cylinder 42 in response to movement of the piston 44 from the uncompressed position into the compressed position. Compression of the gas loads the gas spring assembly in preparation for firing a projectile when actuated by the trigger assembly 24.

As shown in FIG. 1, the gas spring assembly includes a stabilizing element 48. The stabilizing element 48 is preferably, but not necessarily, disposed within the compression cylinder 42, and is disposed adjacent an end of the compression cylinder nearest the barrel 30 of the air gun 20. The stabilizing element 48 stabilizes and/or stiffens the gas spring assembly 28 along the longitudinal axis 46 against a bending moment produced when the air gun 20 is fired. When the air gun 20 is fired, the bending moment is generated in the gas spring assembly 28 between the sealed interface of the piston 44 and the compression cylinder 42, which tends to cause the compression cylinder 42 to flex relative to the piston 44. The added weight and stiffness of the stabilizing element 48 within the compression cylinder 42 increases the resistance to bending between the piston 44 and the compression cylinder 42. Additionally, the additional weight of the stabilizing element 48 reduces felt vibration and or recoil in the air gun 20 in response to firing the air gun 20.

The stabilizing element 48 may include a carbide rod or the like extending along the longitudinal axis 46 within the compression cylinder 42. It should be appreciated that the stabilizing element 48 may include some other material and be configured in some other manner capable of reducing vibration in the air gun 20 when fired, other than shown or described herein.

The gas spring assembly 28 may include a single dynamic gas spring assembly, in which the gas spring assembly 28 includes only one dynamic seal to seal the gas within the compression cylinder 42, or may alternatively include a double dynamic gas spring, in which the gas spring includes two dynamic seals to seal the gas within the compression cylinder 42. It should be appreciated that the gas spring assembly may, but not necessarily, include other components, that are not described in detail herein, depending on the type of gas spring utilized.

Referring to FIGS. 2 and 4, the latch assembly 26 is moveable along the longitudinal axis 46 relative to both the trigger assembly 24 and the gas spring assembly. The latch assembly 26 includes a first end 50 and a second end 52 spaced from the first end 50 along the longitudinal axis 46. As shown in FIG. 4, the first end 50 of the latch assembly 26 is releasably latched or coupled to the trigger assembly 24 when the trigger assembly 24 is in the cocked position, and as shown in FIG. 2, the first end 50 of the latch assembly 26 is de-latched or de-coupled from the trigger assembly 24 when the trigger assembly 24 is in the uncocked position. As shown in FIG. 4, the second end 52 of the latch assembly 26 is releasably latched or coupled to the piston 44 of the gas spring assembly when the piston 44 is in the compressed position, and as shown in FIG. 2, the second end 52 of the latch assembly 26 is de-latched or de-coupled from the piston 44 of the gas spring assembly when the piston 44 is in the uncompressed position.

Movement of the piston 44 from the uncompressed position into the compressed position releasably latches or couples the first end 50 of the latch assembly 26 and the trigger assembly 24, and further releasably latches or couples the second end 52 of the latch assembly 26 and the piston 44. Actuation of the trigger assembly 24 from the cocked position to the uncocked position de-latches or de-couples the trigger assembly 24 from the latch assembly 26 and de-latches or de-couples the latch assembly 26 from the piston 44. De-coupling the trigger assembly 24 from the latch assembly 26, and de-coupling the latch assembly 26 from the piston 44 permits the compressed air within the compression cylinder 42 to decompress the gas spring assembly 28, which moves the piston 44 along the longitudinal axis 46, thereby compressing the air within the compression chamber, which in turn propels the projectile out of the barrel 30.

Figure 3:
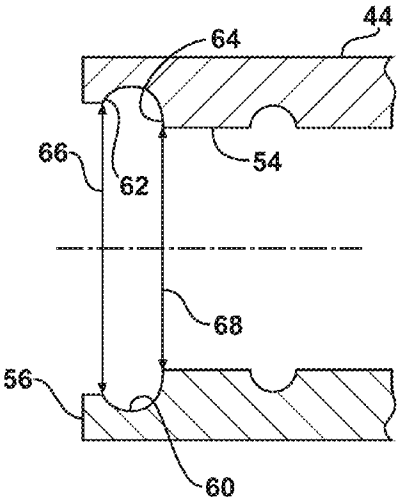
FIG. 3 is an enlarged schematic fragmentary cross sectional view of a piston of the first alternative embodiment of the gas spring assembly.
Figure 8:
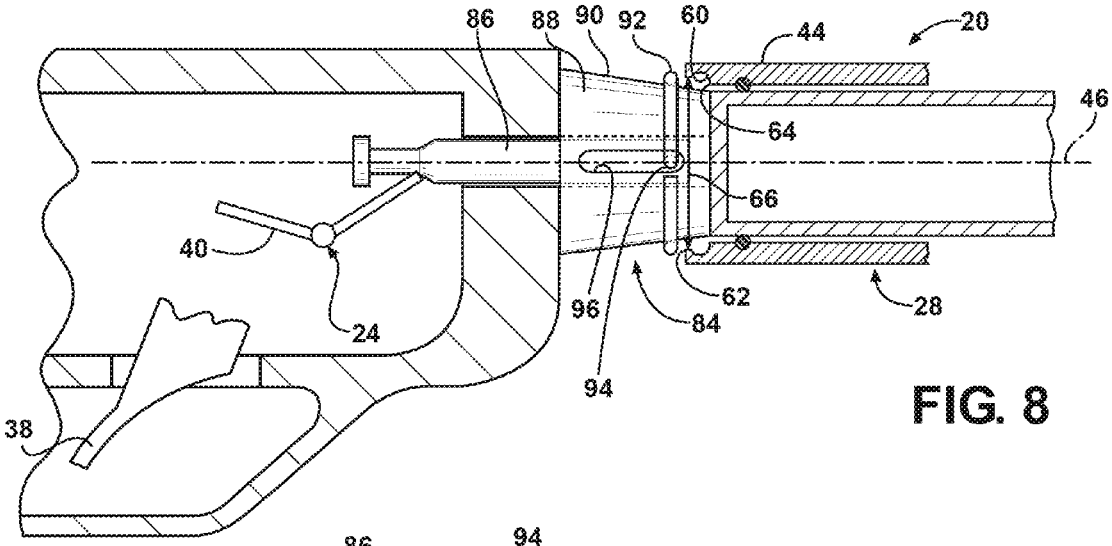
FIG. 8 is a schematic cross sectional view of the air gun showing a trigger assembly in the uncocked position, the first alternative embodiment of the gas spring assembly in the uncompressed position, and a second alternative embodiment of the latch assembly.

Referring to FIG. 3, the piston 44 of the gas spring assembly 28 defines an interior surface 54, and includes a receiving end 56 defining an aperture. The aperture is configured for receiving the second end 52 of the latch assembly 26 therethrough. More specifically, the aperture is configured for receiving a locking portion 58 of the latch assembly 26 therethrough.

The interior surface 54 of the piston 44 defines a recess 60 adjacent the receiving end 56 of the piston 44. The recess 60 is configured for mechanically interlocking with the locking portion 58 of the latch assembly 26 when the piston 44 is in the compressed position. The mechanical interlocking engagement between the recess 60 and the locking portion 58 of the latch assembly 26 couples the latch assembly 26 and the piston 44.

The recess 60 includes a first edge 62 and a second edge 64. The second edge 64 is spaced from the first edge 62 along the longitudinal axis 46. The first edge 62 is disposed nearer the latch assembly 26 than the second edge 64. The first edge 62 defines a first diameter 66, and the second edge 64 defines a second diameter 68 less than the first diameter 66 of the first edge 62.

The trigger assembly 24 defines a bore 70. The bore 70 is generally concentric with and extends along the longitudinal axis 46. The latch assembly 26 is at least partially disposed within the bore 70 in-line with the gas spring assembly, along the longitudinal axis 46. Referring also to FIGS. 5, 6 and 7, the latch assembly 26 includes a barrel portion 72. Preferably, but not necessarily, the barrel portion 72 is concentric with the longitudinal axis 46. The barrel portion 72 of the latch assembly 26 extends through the bore 70 and engages the sear 40 of the trigger assembly 24. The locking portion 58 of the latch assembly 26 is disposed adjacent the second end 52 of the latch assembly 26, and extends outward away from the longitudinal axis 46, through the aperture of the piston 44. The barrel portion 72 of the latch assembly 26 is at least partially disposed within the bore 70. The locking portion 58 of the latch assembly 26 is generally disposed outside of the bore 70. As shown, the locking portion 58 includes a pair of posts 74 disposed on opposing sides of the barrel portion 72 and extending radially outward away from the barrel portion 72.

The locking portion 58 of the latch assembly 26 includes an expandable member 76. The expandable member 76 is supported on a radially outer surface of the locking portion 58 of the latch assembly 26, i.e., on a radially outer surface of the pair of posts 74. The radially outer surface may include a concave surface or the like for supporting the expandable member 76. The expandable member 76 is configured for expanding radially outward away from the longitudinal axis 46 into interlocking engagement with the recess 60 of the piston 44. The expandable member 76 expands radially outward in response to axial movement of the piston 44 along the longitudinal axis 46 from the uncompressed position into the compressed position. Accordingly, movement of the piston 44 causes the expandable member 76 to expand radially outward and engage the recess 60 of the piston 44, which thereby couples the latch assembly 26 and the piston 44 together. As best shown in FIG. 7, the expandable member 76 may include an annular C-shaped spring clip. However, it should be appreciated that the expandable member 76 may differ from that shown and described herein.

One of the latch assembly 26 and the piston 44 includes a wedge surface 78. The wedge surface 78 is configured for directing the expandable member 76 radially outward, into engagement with the recess 60 of the piston 44. Axial movement of the piston 44 moves the expandable member 76 up the wedge surface 78, which causes the expandable member 76 to expand radially outward away from the longitudinal axis 46.

As shown, the latch assembly 26 includes a bushing 80. The bushing 80 defines the wedge surface. The bushing 80 is concentric with and slideably disposed over the barrel portion 72 of the latch assembly 26. Movement of the piston 44 along the longitudinal axis 46 from the uncompressed position into the compressed position moves the expandable member 76 along the longitudinal axis 46 and across the wedge surface to expand the expandable member 76 into the recess 60.

The bushing 80 includes a frustoconical outer surface, which defines the wedge surface 78. The expandable member 76 is at least partially disposed radially outside the frustoconical outer surface relative to the longitudinal axis 46. The bushing 80 defines a slot 82, through which the pair of posts 74 of the locking portion 58 extends radially outward from the longitudinal axis 46. The pair of posts 74 of the locking portion 58 are moveable within the slot 82 along the longitudinal axis 46, to permit the expandable member 76 to move along the wedge surface 78 of the bushing 80.

In operation, as the piston 44 moves from the uncompressed position into the compressed position, the first edge 62 of the recess 60 passes over the expandable member 76 disposed over the wedge surface of the busing. The piston 44 continues to pass over the expandable member 76 until the second edge 64 of the recess 60 contacts the expandable member 76. The second edge 64 of the recess 60 engages the expandable member 76 and moves the latch assembly 26, including the barrel portion 72, the locking portion 58 and the expandable member 76, along the longitudinal axis 46 and up the wedge surface 78 of the bushing 80. As the expandable member 76 moves up the wedge surface 78 of the bushing 80, the expandable member 76 expands radially outward into the recess 60. Additionally, movement of the barrel portion 72 along the longitudinal axis 46 engages the sear 40 on the trigger assembly 24, causing the trigger assembly 24 to move from the uncocked position into the cocked position with the sear 40 of the trigger assembly 24 coupled to the barrel portion 72 of the latch assembly 26. Once the expandable member 76 expands to a diameter greater than the interior diameter of the first edge 62 of the recess 60, the latch assembly 26 and the piston 44 are coupled together. Accordingly, the sear 40 on the trigger assembly 24 prevents the movement of the latch assembly 26, and the latch assembly 26 prevents movement of the piston 44. Once the trigger assembly 24 is actuated, the latch assembly 26 moves along the longitudinal axis 46 toward the gas spring assembly 28, which permits the expandable member 76 to move down the wedge surface of the bushing 80 and contract radially inward toward the longitudinal axis 46. Once the expandable member 76 is contracted to a diameter less than the interior diameter of the first edge 62 of the recess 60, the piston 44 de-couples from the latch assembly 26 and rapidly moves along the longitudinal axis 46 to compress the air within the compression chamber.

Figure 9:
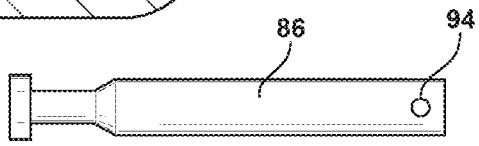
FIG. 9 is a schematic side plan view of a barrel portion of the second alternative embodiment of the latch assembly shown in FIG. 8.
Figure 13:
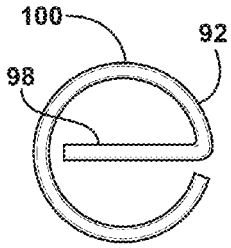
FIG. 13 is a schematic plan view of an expandable member of the second alternative embodiment of the latch assembly shown in FIG. 8.
Figure 10:
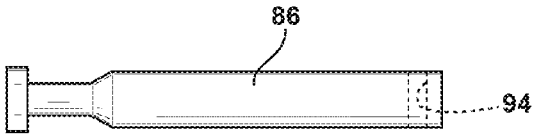
FIG. 10 is a schematic top plan view of the barrel portion of the second alternative embodiment of the latch assembly shown in FIG. 8.
Figure 11:
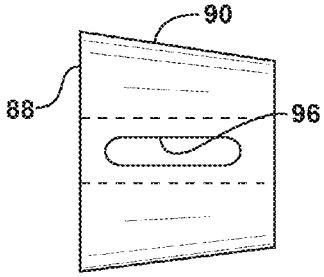
FIG. 11 is a schematic side plan view of a bushing of the second alternative embodiment of the latch assembly shown in FIG. 8.
Figure 12:
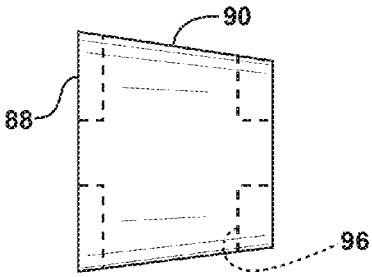
FIG. 12 is a schematic top plan view of the bushing of the second alternative embodiment of the latch assembly shown in FIG. 8.

Referring to FIGS. 8-13, a second alternative embodiment of the latch assembly is shown generally at 84. The second alternative embodiment of the latch assembly 84 includes a barrel portion 86 and a bushing 88 disposed over the barrel portion 86. The bushing 88 includes a frustoconical outer surface that defines a wedge surface 90. An expandable member 92 is disposed radially about the wedge surface 90. Referring to FIGS. 9 and 10, the barrel portion 86 defines a cross bore 94 therethrough. As shown in FIGS. 11 and 12, the bushing 88 defines an elongated cross slot 96. The cross bore 94 is axially disposed along the longitudinal axis 46 within the elongated cross slot 96. As shown in FIG. 13, the expandable member 92 includes a spring clip having an e-shape. The e-shaped spring clip includes a linear middle portion 98 and an annular outer portion 100. The linear middle portion 98 of the e-shaped spring clip extends through the elongated cross slot 96 of the bushing 88 and into interlocking engagement with the cross bore 94 of the barrel portion 86. As such, the barrel portion 86 moves with the e-shaped spring clip. The elongated cross slot 96 of the bushing 88 permits the e-shaped spring clip and the barrel portion 86 to move along the longitudinal axis relative to the bushing 88.

In operation, as the piston 44 moves from the uncompressed position into the compressed position, the first edge 62 of the recess 60 passes over the expandable member 92, i.e., the annular outer portion 100 of the e-shaped spring clip, which is disposed over the wedge surface 90 of the bushing 88. The piston 44 continues to pass over the expandable member 92 until the second edge 64 of the recess 60 contacts the expandable member 92. The second edge 64 of the recess 60 engages the expandable member 92 and moves the latch assembly 84, including the barrel portion 86, and the expandable member 92, along the longitudinal axis and up the wedge surface 90 of the bushing 88. As the expandable member 92 moves up the wedge surface 90 of the bushing 88, the annular outer portion 100 of the expandable member 92 expands radially outward into the recess 60. Additionally, movement of the barrel portion 86 along the longitudinal axis engages the sear 40 on the trigger assembly 24, causing the trigger assembly 24 to move from the uncocked position into the cocked position with the sear 40 of the trigger assembly 24 coupled to the barrel portion 86 of the latch assembly 84. Once the expandable member 92 expands to a diameter greater than the first diameter 66 of the first edge 62 of the recess 60, the latch assembly 84 and the piston 44 are coupled together. Accordingly, the sear 40 of the trigger assembly 24 prevents the movement of the latch assembly 84, and the latch assembly 84 prevents movement of the piston 44. Once the trigger assembly 24 is actuated, the latch assembly 84 moves along the longitudinal axis toward the gas spring assembly 28, which permits the expandable member 92 to move down the wedge surface 90 of the bushing 88 and contract radially inward toward the longitudinal axis. Once the expandable member 92 is contracted to a diameter less than the first diameter 66 of the first edge 62 of the recess 60, the piston 44 de-couples from the latch assembly 84 and rapidly moves along the longitudinal axis to compress the air within the compression chamber.

Figure 14:
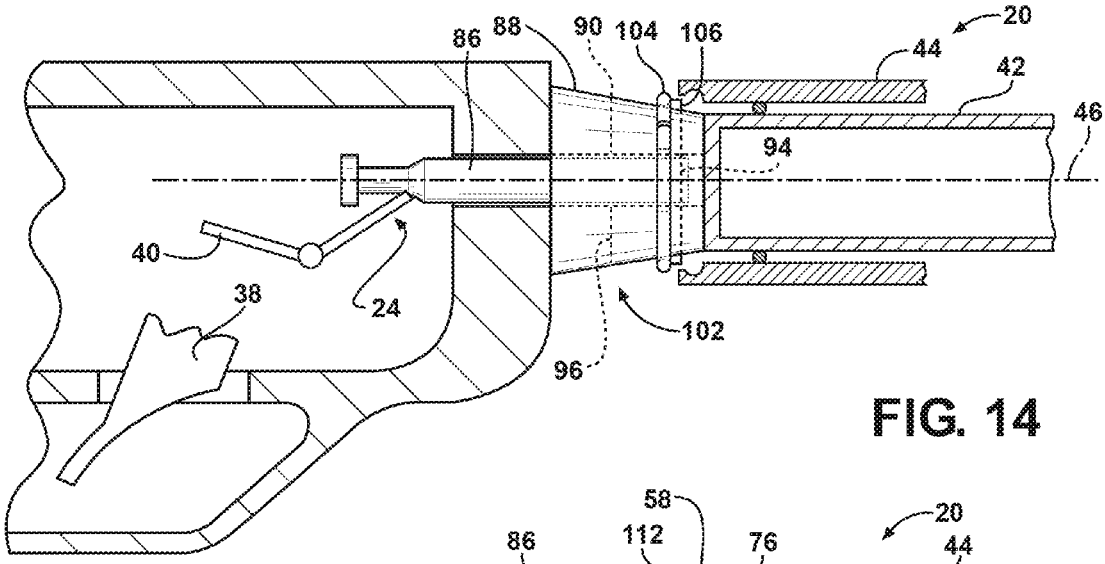
FIG. 14 is a schematic cross sectional view of the air gun showing the trigger assembly in the uncocked position, the first alternative embodiment of the gas spring assembly in the compressed position, and a third alternative embodiment of the latch assembly coupled to the piston of the first alternative embodiment of the gas spring assembly.

Referring to FIG. 14, a third alternative embodiment of the latch assembly is shown generally at 102. The third alternative embodiment of the latch assembly 102 is similar to the second alternative embodiment of the latch assembly 84, and utilizes the barrel portion of the second alternative embodiment of the latch assembly 84 shown in FIGS. 9 and 10, and the bushing 88 of the second alternative embodiment of the latch assembly 84 shown in FIGS. 11 and 12.

The third alternative embodiment of the latch assembly 102 includes an expandable member 104. The expandable member 104 includes an annular C-shaped spring clip disposed about the bushing 88. The third alternative embodiment of the latch assembly 102 further includes a pin 106 extending through the elongated cross slot 96 of the bushing 88 and into interlocking engagement with the cross bore 94 of the barrel portion 86. The annular C-shaped spring clip is disposed between the trigger assembly 24 and the pin 106, with the pin 106 extending outside the outer surface of the bushing 88 to abut and engage the annular C-shaped spring clip. Accordingly, the pin 106 prevents the annular C-shaped spring clip from sliding down and off the wedge surface of the bushing 88, as well as pushes against the annular C-shaped spring clip to ensure that the barrel portion 86 moves with the annular C-shaped spring clip in response to the movement of the piston from the uncompressed position into the compressed position.

Figure 15:
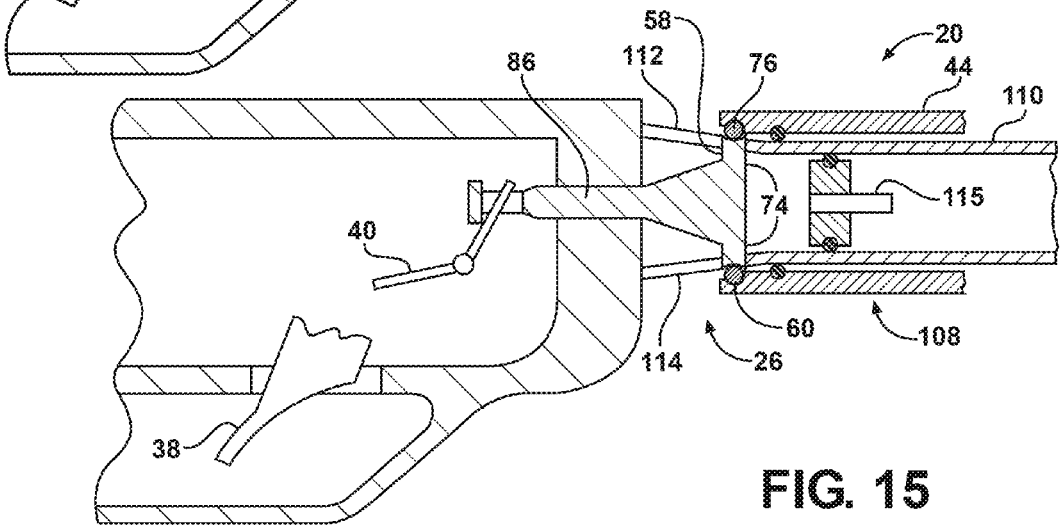
FIG. 15 is a schematic cross sectional view of the air gun showing the trigger assembly in the cocked position, a second alternative embodiment of the gas spring assembly in the compressed position, and the first alternative embodiment of the latch assembly coupled to the piston of the second alternative embodiment of the gas spring assembly.
Figure 16:
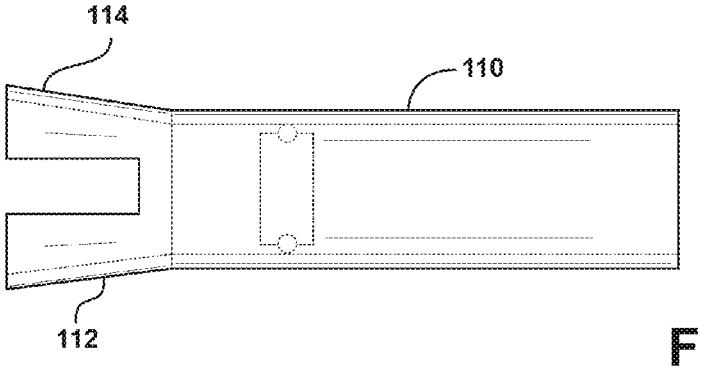
FIG. 16 is a schematic top plan view of a compression cylinder of the second alternative embodiment of the gas spring assembly shown in FIG. 15.

Referring to FIGS. 15 and 16, a second alternative embodiment of the gas spring assembly is shown generally at 108. FIG. 15 shows the second alternative embodiment of the gas spring assembly 108 in combination with the first alternative embodiment of the latch assembly 26. Accordingly, elements of the first alternative embodiment of the latch assembly 26 shown in FIG. 15 are identified by the same reference numerals utilized to identify the various elements of the latch assembly 26 shown in FIGS. 1, 2 and 4-7. The second alternative embodiment of the gas spring assembly 108 includes a compression cylinder 110 and a piston 44. The piston 44 is identical to that shown in FIGS. 1-2 and 4 and described above in the first alternative embodiment of the gas spring assembly 28. As such, the elements of the piston 44 mentioned below in the description of the second alternative embodiment of the gas spring assembly 108 are identified with the same reference numerals utilized to describe the elements of the piston 44 in the first alternative embodiment of the gas spring assembly 28.

The compression cylinder 110 of the second alternative embodiment of the gas spring assembly 108 defines a wedge surface 112. The wedge surface 112 is configured for directing the expandable member 76 radially outward, into engagement with the recess 60 of the piston 44. Axial movement of the piston 44 moves the expandable member 76 up the wedge surface 112, which causes the expandable member 76 to expand radially outward away from the longitudinal axis.

The compression cylinder 110 includes a frustoconically shaped end portion 114, which defines the wedge surface 1 12. The expandable member 76 is at least partially disposed radially outside the frustoconical end portion 114 relative to the longitudinal axis. The frustoconically shaped end portion 114 of the compression cylinder 110 defines a compression cylinder slot, through which the pair of posts 74 of the locking portion 58 extends radially outward from the longitudinal axis. The pair of posts 74 of the locking portion 58 are moveable within the compression cylinder slot along the longitudinal axis, to permit the expandable member 76 to move along the wedge surface 112 of the bushing 80.

Additionally, FIG. 15 shows a valve disposed within the compression cylinder 110. The valve 115 allows the gas spring assembly 108 to be filled with a compressed gas, such as air or nitrogen, after the gas spring assembly 108 is assembled. It should be appreciated that the valve 115 may be disposed at any location within the compression cylinder 110 and/or the piston 44 suitable for introducing the compressed gas into the gas spring assembly 108. While not shown in the other embodiments of the gas spring assembly 28 for clarity, it should be appreciated that all embodiments of the gas spring assembly 28 include the valve for filling the gas spring assembly 28 with the compressed gas.

Referring to FIGS. 17-19, a fourth alternative embodiment of the latch assembly is shown generally at 11 6. FIG. 17 shows the fourth alternative embodiment of the latch assembly 116 in combination with the first alternative embodiment of the gas spring assembly 28. The fourth alternative embodiment of the latch assembly 116 utilizes a barrel portion 86 identical to that of the second alternative embodiment of the latch assembly 116 shown in FIGS. 9 and 10. The fourth alternative embodiment of the latch assembly 116 includes an expandable member 118. The expandable member 118 includes a split collar 120 disposed over the barrel portion 86 of the latch assembly 116. The split collar 120 includes an annular ring 122 extending radially outward away from the longitudinal axis 46. The split collar 120 is slideably disposed over the barrel portion 86 of the latch assembly 116 and defines a longitudinal slot 124 having a first section 126 and a second section 128. The first section 126 of the longitudinal slot 124 defines a first width 130. The second section 128 of the longitudinal slot 124 defines a second width 132. The second width 132 of the longitudinal slot 124 is larger than the first width 130 of the longitudinal slot 124. The fourth alternative embodiment of the latch assembly 116 further includes a pin 134 attached to and extending radially outward from the barrel portion 86. The pin 134 is disposed within and in interlocking engagement with the cross bore 94 of the barrel portion 86. The pin 134 extends transverse to the longitudinal axis 46. The pin 134 defines a wedge surface 136 and is disposed within the second width 132 of the longitudinal slot 124 when the piston 44 is in the uncompressed position. The pin 134 engages the second edge 64 of the recess 60 and moves into the first width 130 of the longitudinal slot 124 to wedge the annular ring 122 radially outward into the recess 60 in response to movement of the piston 44 from the uncompressed position into the compressed position. Movement of the annular ring 122 radially outward increases a diameter of the annular ring 122 to a size greater than the first diameter 66 of the first edge 62 of the recess 60, thereby coupling the latch assembly 116 and the piston 44. Additionally, the pin 134 also moves the barrel portion 86 along the longitudinal axis 46 to engage the trigger assembly 24 and couple the trigger assembly 24 to the barrel portion 86 as described above.

Figure 20:
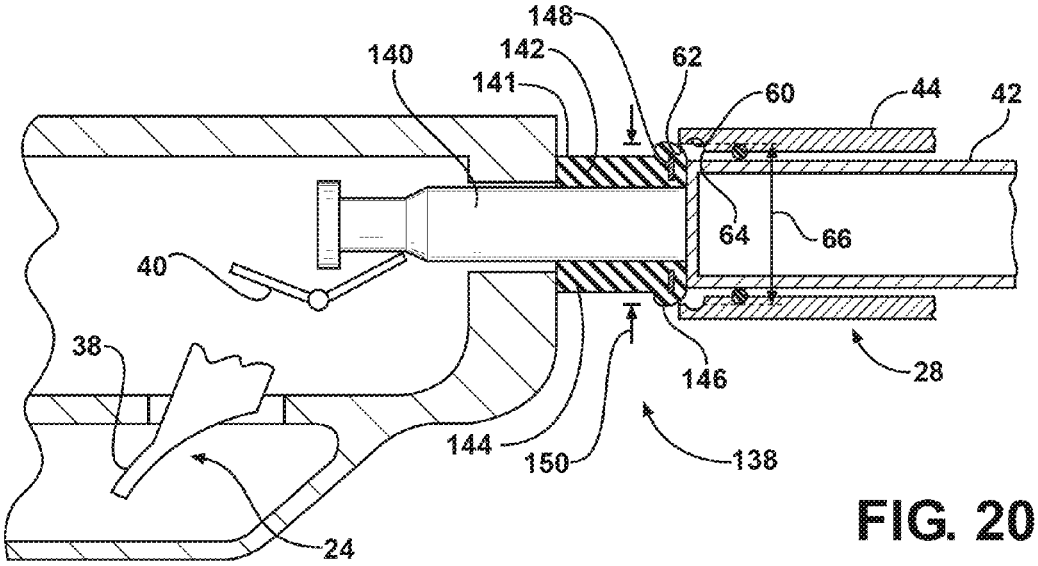
FIG. 20 is a schematic cross sectional view of the air gun showing the trigger assembly in the uncocked position, the first alternative embodiment of the gas spring assembly in the uncompressed position, and a fifth alternative embodiment of the latch assembly.
Figure 21:
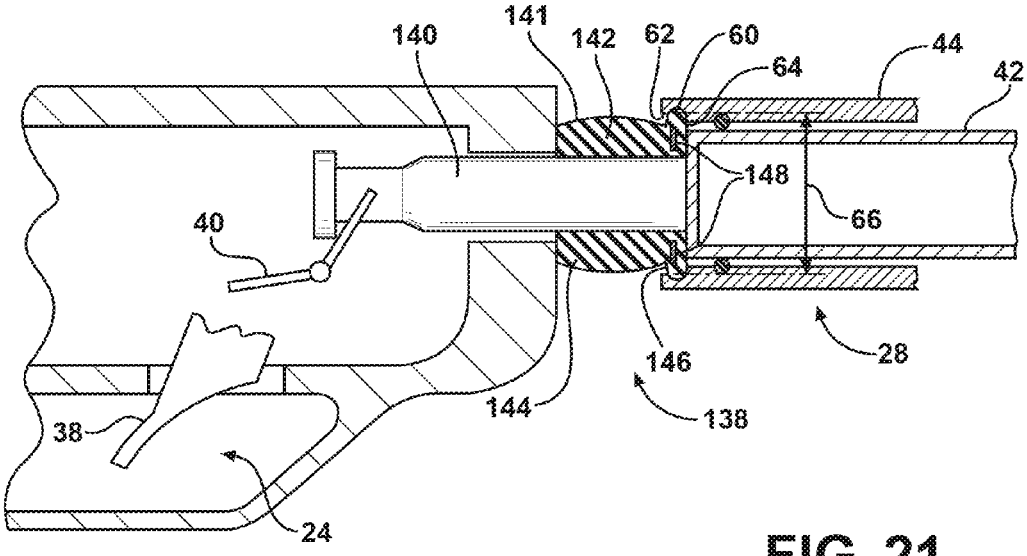
FIG. 21 is a schematic cross sectional view of the air gun shown in FIG. 20 showing the trigger assembly in the cocked position, the gas spring assembly in the compressed position, and the fifth alternative embodiment of the latch assembly coupled to the piston of the first alternative embodiment of the gas spring assembly.

Referring to FIGS. 20 and 21, a fifth alternative embodiment of the latch assembly is shown generally at 138. The fifth alternative embodiment of the latch assembly 138 is shown in combination with the first alternative embodiment of the gas spring assembly 28. The fifth alternative embodiment of the latch assembly 138 includes an expandable member 141 slideably disposed over a barrel portion 140. The barrel portion 140 is similar to the barrel portion 86 shown in FIGS. 9 and 10, but does not include the cross bore 94. The expandable member 141 includes a urethane spring bushing 142 slideably disposed over the barrel portion 140 of the latch assembly 138. The urethane spring bushing 142 includes a base portion 144 and an annular lip 146. The annular lip 146 extends radially outward from the base portion 144 transverse to the longitudinal axis. The annular lip 146 expands radially outward into interlocking engagement with the recess 60 in response to compression of the urethane spring 142 during movement of the piston 44 from the uncompressed position into the compressed position to couple the latch assembly 138 and the piston 44 together.

The urethane spring includes a durometer providing a spring ratio greater than a force required to compress the gas spring assembly 28. Accordingly, the durometer of the urethane spring 142 may vary depending upon the power of the gas spring assembly 28. The urethane spring may include a metal ring 148 disposed within the annular lip 146 portion of the urethane spring 142 to stiffen the annular lip 146 portion.

In operation, the first edge 62 of the recess 60 passes over the annular lip 146 until the annular lip 146 contacts and engages the second edge 64 of the recess 60. Continued movement of the piston 44 compresses the urethane spring, causing the annular lip 146 of the urethane spring 142 to bulge outward until an outer diameter 150 of the annular lip 146 is greater than the first diameter 66 of the first edge 62, thereby coupling the urethane bushing to the piston 44.

Figure 22:
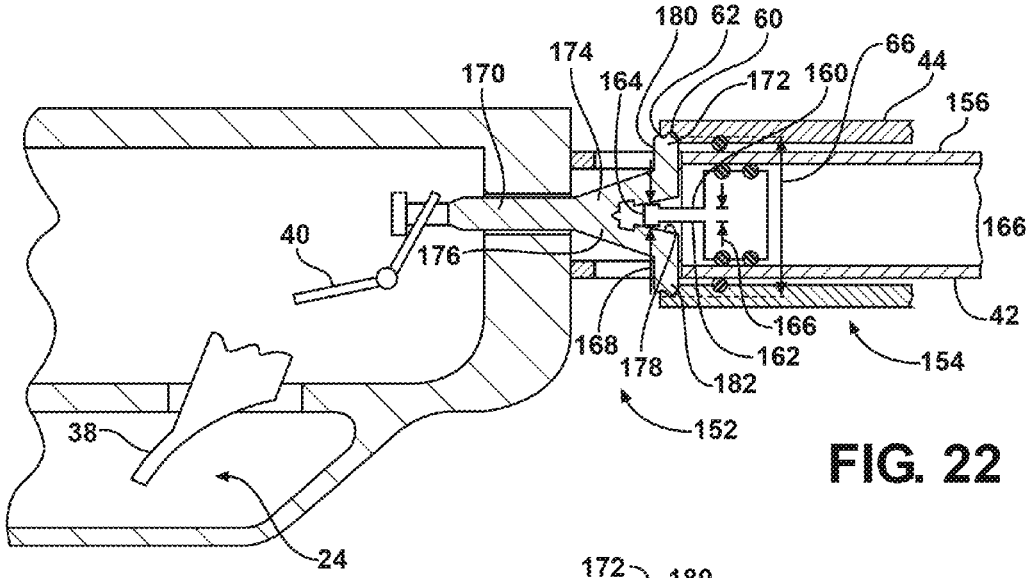
FIG. 22 is a schematic cross sectional view of the air gun showing the trigger assembly in the uncocked position, a third alternative embodiment of the gas spring assembly in the uncompressed position, and a sixth alternative embodiment of the latch assembly.
Figure 23:
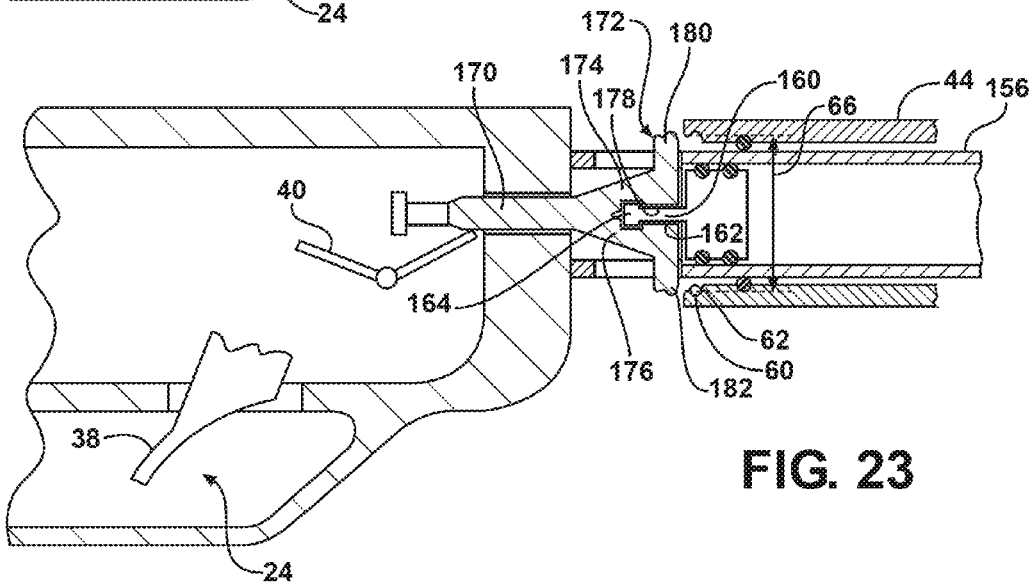
FIG. 23 is a schematic cross sectional view of the air gun showing the trigger assembly in the cocked position, the third alternative embodiment of the gas spring assembly in the compressed position, and the sixth alternative embodiment of the latch assembly coupled to the piston of the third alternative embodiment of the gas spring assembly.

Referring to FIGS. 22 and 23, a sixth alternative embodiment of the latch assembly is shown generally at 152, and a third alternative embodiment of the gas spring assembly is shown generally at 154. The gas spring assembly 154 includes a compression cylinder 156 and a piston 44 slideably disposed over the compression cylinder 156. The piston 44 is identical to that shown in FIGS. 1-2 and 4 and described above in the first alternative embodiment of the gas spring assembly 28. As such, the elements of the piston 44 mentioned below in the description of the sixth alternative embodiment of the latch assembly 152 and shown in FIGS. 22 and 23 are identified with the same reference numerals utilized to describe the elements of the piston 44 in the first alternative embodiment of the gas spring assembly 28.

The compression cylinder 156 includes a peg 160 extending along the longitudinal axis toward the latch assembly 152. The peg 160 includes a shaft portion 162 extending to a distal bulbous portion 164. The shaft portion 162 defines a shaft thickness 166 and the bulbous portion 164 defines an end thickness 168. The end thickness 168 of the bulbous portion 164 is greater than the shaft thickness 166 of the shaft portion 162.

Figure 24:
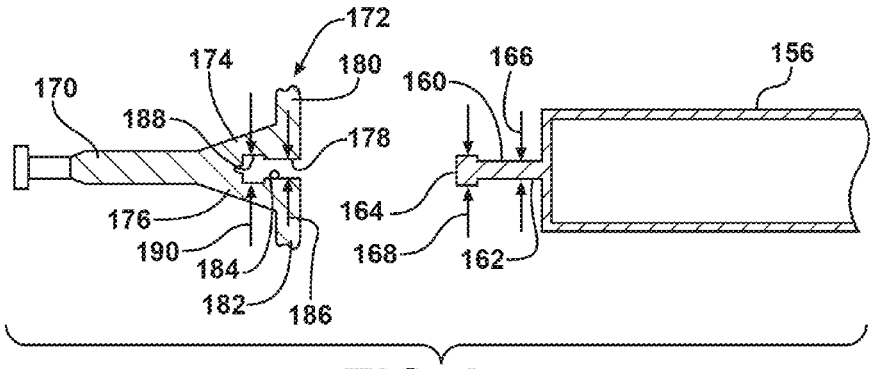
FIG. 24 is a cross sectional view of an alternative embodiment of the compression cylinder of the third alternative embodiment of the gas spring assembly.

As shown in FIGS. 22 and 23, the peg 160 may be a separate piece from the compression cylinder 156, disposed within and sealed relative to an interior of the compression cylinder 156. Alternatively, as shown in FIG. 24, the peg 160 may be integrally formed with the compression cylinder 156 as a single manufacture.

The sixth alternative embodiment of the latch assembly 152 includes a barrel portion 170 and a locking portion 172. The barrel portion 170 includes a first arm portion 174 and a second arm portion 176. The first arm portion 174 and the second arm portion 176 define a barrel slot 178 therebetween extending along the longitudinal axis. The barrel slot 178 is disposed between the first arm portion 174 and the second arm portion 176. The locking portion 172 includes a first post 180 and a second post 182 with the first post 180 extending radially outward from the first arm portion 174 away from the longitudinal axis and the second post 182 extending radially outward from the second arm portion 176 away form the longitudinal axis and away form the first post 180.

The barrel slot 178 includes a first section 184 defining a first width 186 and a second section 188 defining a second width 190. The second width 190 of the slot is larger than the first width 186 of the slot. The bulbous portion 164 of the peg 160 is disposed within the second width 190 of the slot when the piston 44 is in the uncompressed position. Movement of the piston 44 from the uncompressed position into the compressed position moves the latch assembly 152 along the longitudinal axis, which causes the bulbous portion 164 to move within the slot. More specifically, the bulbous portion 164 moves into the first width 186 of the barrel slot 178 as the piston 44 moves the barrel portion 170 and the locking portion 172 of the latch assembly 152 along the longitudinal axis. As the bulbous portion 164 moves into the first width 186 of the barrel slot 178, the bulbous portion 164 wedges the first arm portion 174 and the second arm portion 176 radially outward away from each other until the first arm portion 174 and the second arm portion 176 define a distance therebetween that is greater than the interior diameter of the first edge 62 of the recess 60. Once the distance between the first arm portion 174 and the second arm portion 176 is greater than the first diameter 66 of the first edge 62 of the recess 60, the latch assembly 152 and the gas spring assembly 154 are coupled together.

While the best modes for carrying out the invention have been described in detail, those familiar with the art to which this invention relates will recognize various alternative designs and embodiments for practicing the invention within the scope of the appended claims.

The invention claimed is:

1. An air gun comprising:

a trigger assembly moveable between a cocked position and an uncocked position;

a gas spring assembly including a compression cylinder and a piston slideably disposed about and moveable along a longitudinal axis relative to said compression cylinder between a compressed position and an uncompressed position, wherein said gas spring assembly is configured for compressing a gas within said compression cylinder in response to movement of said piston from said uncompressed position into said compressed position to load said gas spring assembly in preparation for firing a projectile when actuated by said trigger assembly; and a latch assembly moveable along said longitudinal axis relative to said trigger assembly and said gas spring assembly, said latch assembly including a first end and a second end spaced from said first end along said longitudinal axis with said first end releasably latched to said trigger assembly when said trigger assembly is in said cocked position and said first end de-latched from said trigger assembly when said trigger assembly is in said uncocked position, and said second end releasably latched to said piston of said gas spring assembly when said piston is in said compressed position and said second end de-latched from said piston of said gas spring assembly when said piston is in said uncompressed position.

2. An air gun as set forth in claim 1 wherein movement of said piston from said uncompressed position into said compressed position releasably latches said first end of said latch assembly and said trigger assembly, and further releasably latches said second end of said latch assembly and said piston.

3. An air gun as set forth in claim 2 wherein actuation of said trigger assembly from said cocked position to said uncocked position de-latches said trigger assembly from said latch assembly and de-latches said latch assembly from said piston to permit the compressed air within said compression cylinder to move said piston along said longitudinal axis for propelling the projectile.

4. An air gun as set forth in claim 1 wherein said trigger assembly defines a bore and said latch assembly is at least partially disposed within said bore in-line with said gas spring along said longitudinal axis.

5. An air gun as set forth in claim 4 wherein said latch assembly includes a barrel portion at least partially disposed within said bore, wherein said barrel portion is concentric with said longitudinal axis.

6. An air gun as set forth in claim 5 wherein said latch assembly includes a locking portion disposed adjacent said second end of said latch assembly.

7. An air gun as set forth in claim 6 wherein said piston defines an interior surface and includes a receiving end defining an aperture configured for receiving said locking portion of said latch assembly therethrough.

8. An air gun as set forth in claim 7 wherein said interior surface of said piston defines a recess adjacent said receiving end of said piston, wherein said recess is configured for mechanically interlocking with said locking portion of said latch assembly when said piston is in said compressed position to latch said latch assembly and said piston together.

9. An air gun as set forth in claim 8 wherein said recess includes a first edge and a second edge spaced from said first edge along said longitudinal axis with said first edge disposed nearer said latch assembly than said second edge and wherein said first edge defines a first diameter and said second edge defines a second diameter less than said first diameter of said first edge.

10. An air gun as set forth in claim 9 wherein said barrel portion includes a first arm portion and a second arm portion defining a slot extending along said longitudinal axis between said first arm portion and said second arm portion, and wherein said locking portion includes a first post and a second post with said first post extending radially outward from said first arm portion away from said longitudinal axis and said second post extending radially outward from said second arm portion away from said longitudinal axis and away from said first post.

11. An air gun as set forth in claim 10 wherein said compression cylinder includes a peg extending along said longitudinal axis toward said latch assembly and including a shaft portion extending to a distal bulbous portion, wherein said shaft portion defines a thickness and said bulbous portion defines a thickness greater than said thickness of said shaft portion.

12. An air gun as set forth in claim 11 wherein said slot disposed between said first arm portion and said second arm portion includes a first section defining a first width and a second section defining a second width larger than said first width, wherein said bulbous end portion of said peg is disposed within said second width when said piston is in said uncompressed position and moves into said first width to wedge said first arm portion and said second arm portion radially outward into said recess in response to movement of said piston from said uncompressed position into said compressed position to latch said latch assembly and said piston together.

13. An air gun as set forth in claim 8 wherein said locking portion includes an expandable member configured for expanding radially outward away from said longitudinal axis into interlocking engagement with said recess of said piston in response to axial movement of said piston along said longitudinal axis from said uncompressed position into said compressed position.

14. An air gun as set forth in claim 13 wherein one of said latch assembly and said piston includes a wedge surface configured for directing said expandable member radially outward.

15. An air gun as set forth in claim 14 further comprising a bushing defining said wedge surface, said bushing concentric with and slideably disposed over said barrel portion of said latch assembly, wherein movement of said piston along said longitudinal axis from said uncompressed position into said compressed position moves said expandable member along said longitudinal axis and across said wedge surface to expand said expandable member into said recess.

16. An air gun as set forth in claim 15 wherein said bushing includes a frustoconical outer surface defining said wedge surface with said expandable member at least partially disposed radially outside said frustoconical outer surface relative to said longitudinal axis.

17. An air gun as set forth in claim 14 wherein said expandable member includes a split collar including an annular ring extending radially outward away from said longitudinal axis, wherein said split collar is slideably disposed over said barrel portion of said latch assembly and defines a longitudinal slot having a first section defining a first width and a second section defining a second width larger than said first width; and wherein said latch assembly further comprises a pin attached to and extending radially outward from said barrel portion transverse to said longitudinal axis, wherein said pin defines said wedge surface and is disposed within said second width when said piston is in said uncompressed position and moves into said first width to wedge said annular ring radially outward into said recess in response to movement of said piston from said uncompressed position into said compressed position to latch said latch assembly and said piston together.

18. An air gun as set forth in claim 13 wherein said expandable member includes a urethane spring bushing slideably disposed over said barrel portion of said latch assembly, said urethane spring bushing including a base portion and an annular lip extending radially outward from said base portion transverse to said longitudinal axis, wherein said annular lip expands radially outward into interlocking engagement with said recess in response to compression of said urethane spring during movement of said piston from said uncompressed position into said compressed position to latch said latch assembly and said piston together.

19. A gas spring assembly for an air gun, said gas spring assembly comprising:

compression cylinder extending along a longitudinal axis;

a piston slideably disposed about and moveable along said longitudinal axis relative to said compression cylinder between a compressed position and an uncompressed position, wherein said compression cylinder and said piston are configured for compressing a gas within said compression cylinder in response to movement of said piston from said uncompressed position into said compressed position; and a latch assembly including a barrel portion concentric with said longitudinal axis, said latch assembly moveable along said longitudinal axis relative to said compression cylinder and said piston and including a first end and a second end spaced from said first end along said longitudinal axis with said second end releasably latched to said piston when said piston is in said compressed position and said second end de-latched from said piston when said piston is in said uncompressed position;

wherein said latch assembly includes a locking portion disposed adjacent said second end of said latch assembly, and wherein said piston includes a receiving end defining an aperture and an interior surface defining a recess adjacent said receiving end with said receiving end configured for receiving said locking portion therethrough and said recess configured for mechanically interlocking with said locking portion of said latch assembly when said piston is in said compressed position.

20. A gas spring assembly as set forth in claim 19 wherein said locking portion includes an expandable member configured for expanding radially outward away from said longitudinal axis into interlocking engagement with said recess of said piston in response to axial movement of said piston along said longitudinal axis from said uncompressed position into said compressed position to latch said latch assembly and said piston together.

21. A gas spring assembly as set forth in claim 20 wherein one of said latch assembly and said piston includes a wedge surface configured for directing said expandable member radially outward.

22. A gas spring assembly as set forth in claim 21 wherein said expandable member includes a split collar including an annular ring extending radially outward away from said longitudinal axis, wherein said split collar is slideably disposed over said barrel portion of said latch assembly and defines a longitudinal slot having a first section defining a first width and a second section defining a second width larger than said first width; and wherein said latch assembly further comprises a pin attached to and extending radially outward from said barrel portion transverse to said longitudinal axis, wherein said pin defines said wedge surface and is disposed within said second width when said piston is in said uncompressed position and moves into said first width to wedge said annular ring radially outward into said recess in response to movement of said piston from said uncompressed position into said compressed position to latch said latch assembly and said piston together.

23. A gas spring assembly as set forth in claim 20 wherein said expandable member includes a urethane spring bushing slideably disposed over said barrel portion of said latch assembly, said urethane spring bushing including a base portion and an annular lip extending radially outward from said base portion transverse to said longitudinal axis, wherein said annular lip expands radially outward into interlocking engagement with said recess in response to compression of said urethane spring during movement of said piston from said uncompressed position into said compressed position to latch said latch assembly and said piston together.

24. A gas spring assembly as set forth in claim 19 further including a stabilizing element disposed within said compression cylinder and configured for stiffening said compression cylinder against bending.

25. A gas spring assembly as set forth in claim 19 wherein:

said barrel portion includes a first arm portion and a second arm portion defining a slot extending along said longitudinal axis between said first arm portion and said second arm portion, and wherein said locking portion includes a first post and a second post with said first post extending radially outward from said first arm portion away from said longitudinal axis and said second post extending radially outward from said second arm portion away from said longitudinal axis and away from said first post;

wherein said compression cylinder includes a peg extending along said longitudinal axis toward said latch assembly and including a shaft portion extending to a distal bulbous portion, wherein said shaft portion defines a thickness and said bulbous portion defines a thickness greater than said thickness of said shaft portion; and wherein said slot disposed between said first arm portion and said second arm portion includes a first section defining a first width and a second section defining a second width larger than said first width, wherein said bulbous end portion of said peg is disposed within said second width when said piston is in said uncompressed position and moves into said first width to wedge said first arm portion and said second arm portion radially outward into said recess in response to movement of said piston from said uncompressed position into said compressed position to latch said latch assembly and said piston together.

* * * * *